US005855474A

United States Patent [19]

Shouman

[11] Patent Number: 5,855,474

[45] Date of Patent: Jan. 5, 1999

[54] MULTIPLE PURPOSE TWO STAGE ROTATING VANE DEVICE

[76] Inventor: Ahmad R. Shouman, 1006 Bloomdale, Las Cruces, N. Mex. 88005

[21] Appl. No.: 583,419

[22] Filed: Jan. 5, 1996

[51] Int. Cl.[6] ..... F01C 1/30

[52] U.S. Cl. ..... 418/6; 418/13; 418/146; 418/158

[58] Field of Search ..... 418/6, 13, 235, 418/158, 145, 146

[56] References Cited

U.S. PATENT DOCUMENTS

| | | | |
|---|---|---|---|
| 2,759,664 | 8/1956 | Auwarter | 418/6 |
| 2,952,249 | 9/1960 | Conover, Jr. | 418/158 |
| 3,053,438 | 9/1962 | Meyer | 418/235 |
| 3,165,093 | 1/1965 | Extergoien | 418/6 |
| 4,015,441 | 4/1977 | Robinet | 418/13 |
| 4,331,223 | 5/1982 | Charlet et al. | 418/158 |
| 5,375,985 | 12/1994 | Pipaloff | 418/6 |

*Primary Examiner*—Charles G. Freay
*Attorney, Agent, or Firm*—Milton D. Wyrick

[57] ABSTRACT

A two-stage rotating vane device comprising an outer stator defining a plurality of ports and an elliptically or cylindrically shaped interior cavity surface, with an inner stator defining a plurality of ports, the inner stator either being elliptically shaped or configured in a predetermined shape and located in the elliptically or cylindrically shaped interior cavity. A rotor is disposed in the elliptically or cylindrically shaped interior cavity between the interior cavity surface of the outer stator and the inner stator, the rotor defining a plurality of slots. A plurality of slidable vanes are situated in the plurality of slots for spanning between the interior cavity surface of the outer stator and the inner stator, and wherein a first stage is defined between the inner stator and the rotor, and a second stage is defined between the interior cavity surface of the outer stator and the rotor, the first and second stages communicating with each other. The present invention can be configured as a two-stage compressor, expander, or turbine engine, or combinations of these.

3 Claims, 5 Drawing Sheets

MULTIPLE PURPOSE TWO STAGE ROTATING VANE DEVICE

FIELD OF THE INVENTION

The present invention generally relates to vane devices, and more specifically to two stage vane devices suitable for multiple purposes, including as a compressor, and expander, turbine engine, or a refrigerator, or as combinations of these.

BACKGROUND OF THE INVENTION

There are a great many engineering applications that require an expander or compressor capable of handling a two phase flow of liquid and vapor. For example, two phase expanders improve the efficiency of geothermal power plants. Also, if a two phase expander were to replace the throttling valve of a refrigerator or an air conditioner, the coefficient of performance of these devices could be improved by approximately 25%. Their performance could be even further improved if a two phase compressor could be developed. In considering the above-described applications, one with skill in this art would conclude that for such a two phase device to be of use, it would have to be capable of utilizing a very high expansion ratio or of producing a very high compression ratio. It also would have a high adiabatic efficiency.

U.S. Pat. No. 2,990,109, issued Jun. 27, 1964, to G. D. Fraser describes the basic concepts which are improved upon by the present invention. The Fraser patent describes a double acting rotary compressor having an elliptic stator, and elliptic chamber, and a hollow tubular rotor which Fraser described as follows: "The tubular rotor has plurality of equally spaced vane slots containing vanes which are slidable in said slots and make contact at all times with the elliptical surface of the stator and the elliptical wall of the casing chamber." Fraser specified that the rotor would be in contact with the inner elliptical stator at both ends of the major axis of the ellipse while contacting the outer elliptical stator chamber at the ends of the minor axis in order to produce his desired result. As Fraser states: "The result of this construction is that two diametrically opposed crescent-shaped chambers are formed between the outer tubular surface of the rotor and the elliptical wall of the casing chamber, forming one compressor stage; and two diametrically opposed crescent-shaped chambers are formed between the elliptical surface of the stator and the inner tubular surface of the rotor, constituting the second compressor stage." Fraser also specified a certain design for the vanes and that the intake and discharge passages be part of the cover plate. As stated by Fraser: "Additional novel features of the invention, hereinafter more fully described, include the construction and arrangement of the vanes carried by the rotor, and the various combination of elements including in particular the intake and discharge passages in the cover plate cooperating with the different compressor chambers."

It is an object of the present invention to provide a two stage rotating vane apparatus which can be used as pump, compressor, expander, gas turbine engine, a refrigerator or air conditioner, or a turbo-supercharger for internal combustion engines.

It is further object of the present invention to provide a two stage rotating vane apparatus in which the tubular rotor does not contact either stator.

It is a still further object of the present invention to provide a two stage rotating vane apparatus in which intake and discharge ports are located on the walls of the stator at the appropriate angles for a desired application of the invention.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, apparatus for providing a multiple purpose two stage vane device comprises an outer stator defining a plurality of ports and an elliptically shaped interior cavity surface, and an inner stator defining a plurality of ports, the inner stator being elliptically shaped and located in the elliptically shaped interior cavity. A rotor is disposed in the elliptically shaped interior cavity between the interior cavity surface of the outer stator and the inner cavity, the rotor defining a plurality of slots. A plurality of slidable vanes are situated in the plurality of slots for spanning between the interior cavity surface of the outer stator and the inner stator, and wherein a first stage is defined between the inner stator and the rotor, and a second stage is defined between the interior cavity surface of the outer stator and said rotor, the first and second stages communicating with each other.

BRIEF DESCRIPTION OF THE DRAWINGS

The accompanying drawings, which are incorporated in and form a part of the specification, illustrate the embodiments of the present invention and, together with the description, serve to explain the principles of the invention.

In the drawings.

DETAILED DESCRIPTION OF THE INVENTION

The present invention provides a two-stage rotating vane device that can be used as either an expander or compressor depending on the arrangement of the ports and the direction of rotation. As will be hereinafter further explained, the two stages can be used in parallel, to operate as a low expansion ratio expander or a low compression ratio compressor. Alternatively, when the two stages are used in series, a very high expansion ratio expander or a very high compression ratio compressor results. Both the expander and compressor are capable of handling a mixture of liquid, vapor and solids or a combination of any of the three phases. The symmetrical design of the invention produces a dynamically balanced system and a minimum frictional loss, thus providing high adiabatic efficiency machines. The invention can be best understood by reference to the drawings.

Figure 1:
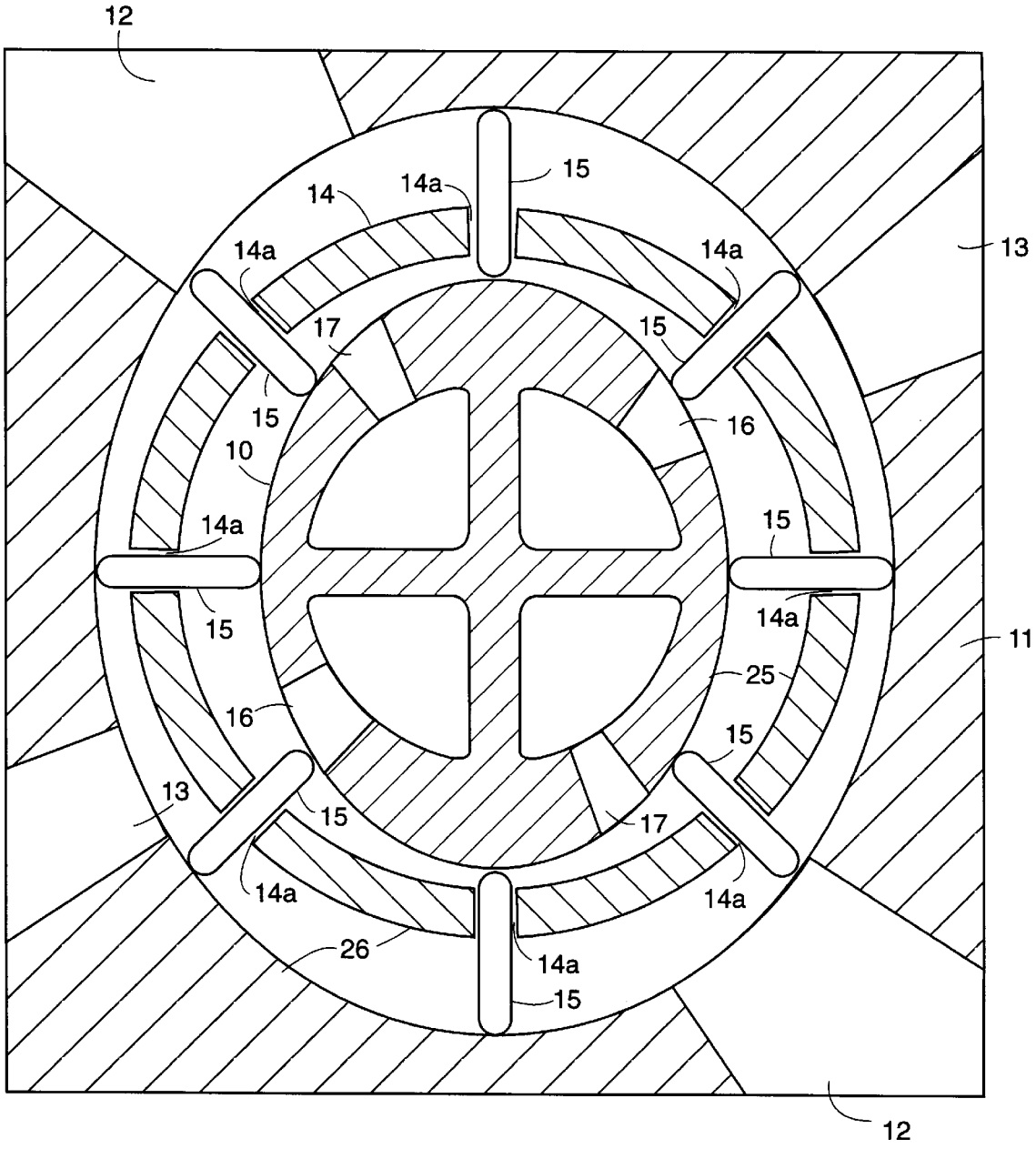
FIG. 1 is a cross-sectional frontal view illustrating the elements of one embodiment of the present invention.
Figure 2:
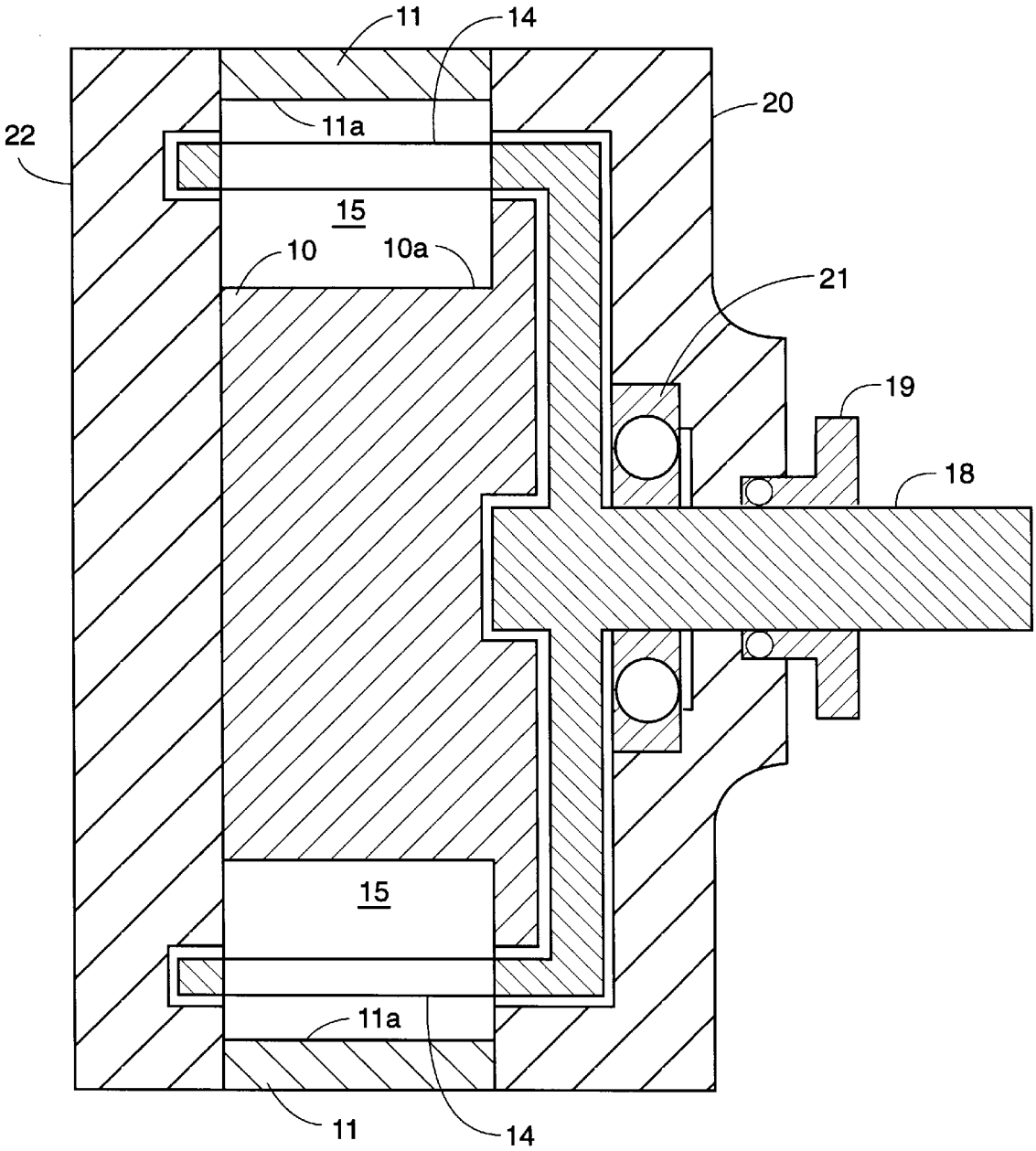
FIG. 2 is a cross-sectional side view of the embodiment of the invention shown in FIG. 1.

In FIGS. 1 and 2, cross-sectional front and side views, respectively, of one embodiment of the present invention are illustrated. Depending on the arrangement of elements of the invention, the apparatus can be employed as an expander, a compressor, a gas turbine engine, a refrigerator or air conditioner, or a turbo-supercharger for internal combustion engines. The elements of the present invention include an inner stator 10, an outer stator 11 defining ports 12 and 13, a rotor 14, and any number of vanes 15 required for a particular application. The embodiment shown in FIG. 1 uses eight vanes 15, although this number is not to limit the present invention in any way.

Inner stator 10 is shown elliptic in shape, but may have any desirable symmetrical shape, and defines two sets of symmetrical ports 16, 17. Rotor 14 is cylindrical in shape, and is coaxial with inner stator 10 and outer stator 11. Rotor 14 defines slots 14*a* to accept vanes 15, and, as shown in FIG. 2, is connected to shaft 18, which is mounted on a ball or sleeve bearing 21. Ball or sleeve bearing 21 is mounted on cover plate 20 on which seal 19 is mounted to prevent leakage. Rear cover plate 22 has inner stator 10 connected to it and acts as a bearing for rotor 14. Outer stator 11 and both cover plates 20, 22 are all bolted together to produce a tight, leak-proof device. If required, gaskets (not shown) can be used to provide sealing.

Outer stator 11, as illustrated in FIGS. 1 and 2, is constructed so that the radial distance from outside surface 10*a* of inner stator 10 and inside surface 11*a* of outer stator 11 is constant and equal to the length of vanes 15. Hence, outside surface 10*a* and inside surface 11*a* define similar shapes, as that term is used mathematically. Outer stator 11 defines two sets of symmetrical ports 12, 13.

For the purposes of the present application, as shown in FIG. 1, first stage 25 is defined to include inner stator 10 and the volume between inner stator 10 and rotor 14. Second stage 26 is defined to included outer stator 11 and the volume between outer stator 11 and rotor 14.

Figure 3:
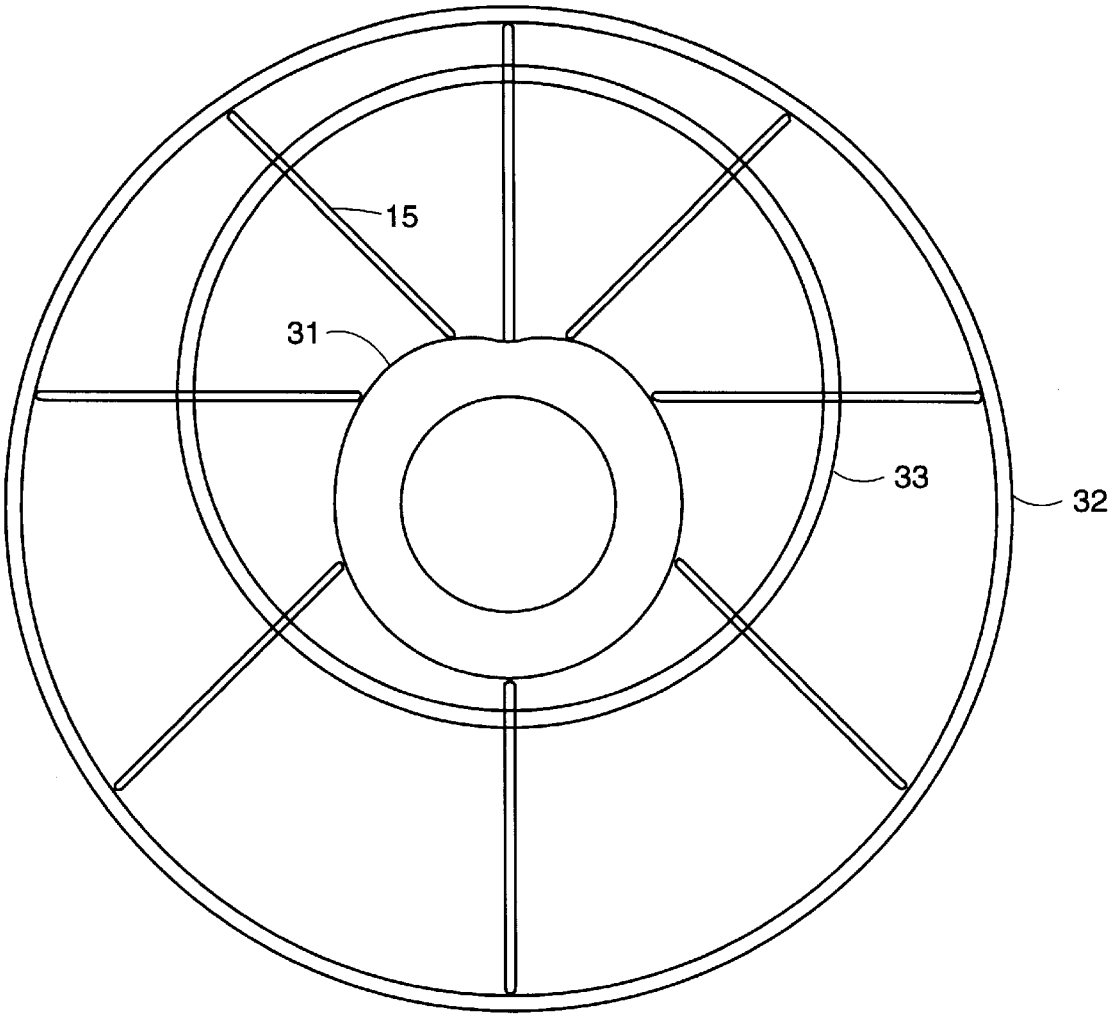
FIG. 3 is a cross-sectional frontal view of an embodiment of the present invention in which the outer stator defines a cylindrical cavity and the inner stator is configured to provide a geometry which allows for a definite vane length at all angular positions.

Another embodiment of the invention is illustrated in FIG. 3 which may be more easily manufactured than the embodiment of FIGS. 1 and 2. As seen in FIG. 3, inner stator 31 is configured in a specific geometry which will allow for a specific length of vanes 15 at all angular positions, and the cavity defined by outer stator 32 is cylindrically shaped. Rotor 33 is also cylindrically shaped, but has an axis which is eccentric with respect to the coaxially located inner stator 31 and outer stator 32. All other functions of this embodiment are identical with those of the earlier embodiment of FIGS. 1 and 2. The fact that inner stator 31 and the cavity of outer stator 32 are generally cylindrically shaped may make this embodiment easier to manufacture, and therefore less expensive.

Referring back to FIG. 1, for operation of the invention when configured as an expander with two stages in parallel, high pressure fluid is applied through ports 13 and 17, causing counter clockwise rotation of rotor 14. Clockwise rotation can be obtained for this configuration by relocation of ports 13, 17. Both first stage 25 and second stage 26 must be designed for the same expansion ratio.

When operating as a compressor or a pump, in the parallel stage mode, low pressure fluid is introduced through ports 12, 18, and rotor 14 is rotated in the clockwise direction for the embodiment illustrated. Counterclockwise rotation can be obtained for this configuration by relocation of ports 12, 18. Again, first stage 25 and second stage 26 must be designed for the same, in this case, pressure ratio.

The invention can also be configured as an expander, with the two stages in series. Again referring to FIGS. 1 and 2, it can be seen that in this configuration, high pressure fluid is introduced through ports 17, causing counter clockwise rotation of rotor 14 for the configuration shown in FIG. 1. Fluid leaves rotor 14 through ports 16 inner stator 10 which would be connected to ports 13 in outer stator 11. The fluid finally leaves rotor 14 ports 12 of outer stator 11 from which it would be exhausted. In this application, both first stage 25 and second stage 26 must be designed to accommodate the same mass flow rate.

When operation of the invention as a compressor is desired, with both first stage 25 and second stage 26 in series, low pressure fluid is introduced through ports 12 in outer stator 11. The fluid leaves outer stator 11 through ports 13, which would be connected to ports 16 in inner stator 10. The now high pressure fluid finally leaves rotor 14 through ports 17. For the configuration illustrated in FIGS. 1 and 2, rotation of rotor 14 is in the clockwise direction. As before, both first stage 25 and second stage 26 must be designed for the same mass flow rate. For reversal of rotation of rotor 14, the arrangement of ports 12, 13 and ports 16, 17 would be reversed.

For operation of the invention as a gas turbine engine, first stage 25 is configured as a compressor and second stage 26 is configured as a turbine, with the arrangement of ports 12, 13 and ports 16, 17 is made to provide the desired direction of rotation of rotor 14. In this application, first stage 25 and second stage 26 must be designed for the same mass flow rate and pressure ratio.

The present invention can be configured to provide a refrigerator or an air conditioner. In this application, second stage 26 operates as a compressor, and first stage 25 operates as an expander.

Additionally, the present invention can be configured to provide a turbo-supercharger for internal combustion engines. In this application, second stage 26 operates as an expander, and first stage 25 operates as a compressor.

All of these configurations require only external piping to connect the various ports together. These connections are well within the ability of persons of ordinary skill in this art.

Figure 4:
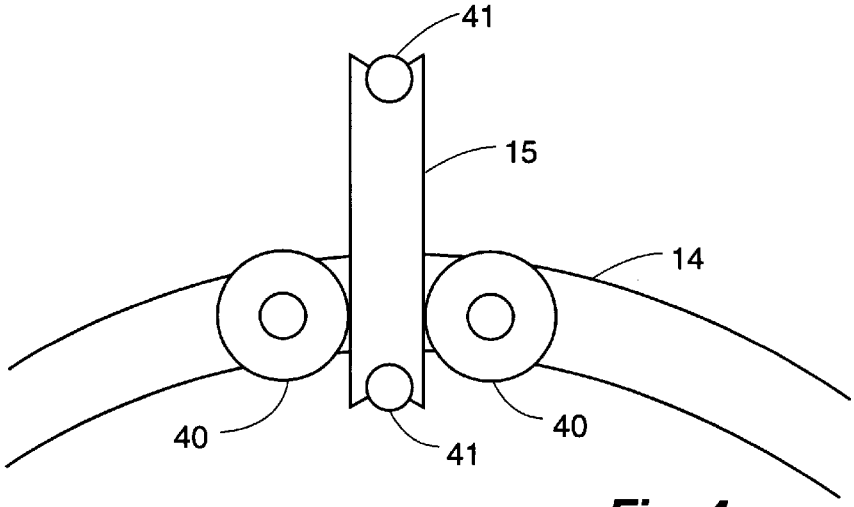
FIG. 4 is plan view of another embodiment of the vanes and rotor of the present invention with rollers provided to minimize friction.

Referring now to FIG. 4, there can be seen an alternative embodiment for vanes 15 and rotor 14 with rollers 40, attached to rotor 14, provided to minimize friction with rotor 14. Here, rollers 41 are positioned at each end of vane 15 to rollingly contact the surfaces of inner stator 10 and outer stator 11 (FIG. 1).

Figure 5B:
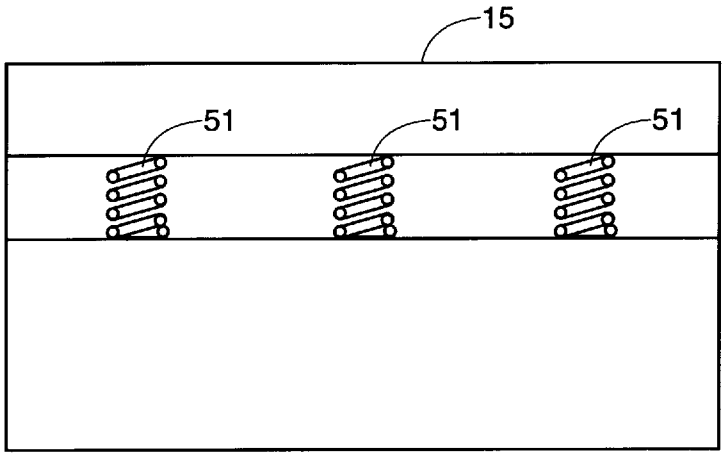
FIG. 5 at "a" and "b" illustrates two types of spring arrangements for providing self-compensating wear adjustment for the vanes of the present invention.
Figure 5A:
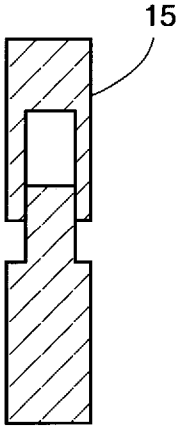
Figure 5A:
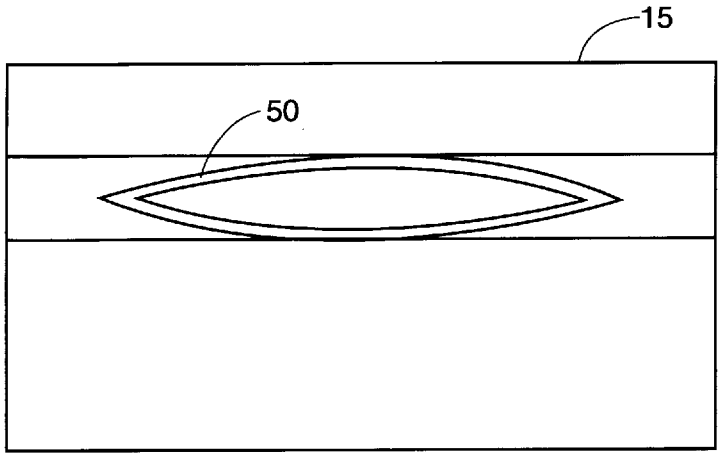

In FIG. 5, vanes 15 are split and shown with either leaf springs 50 at a, or coil springs 51 at b between the two halves. Springs 50, 51 act to automatically compensate for wear in either vanes 15, or in inner stator 10 or outer stator 11 (FIG. 1).

Figure 6:
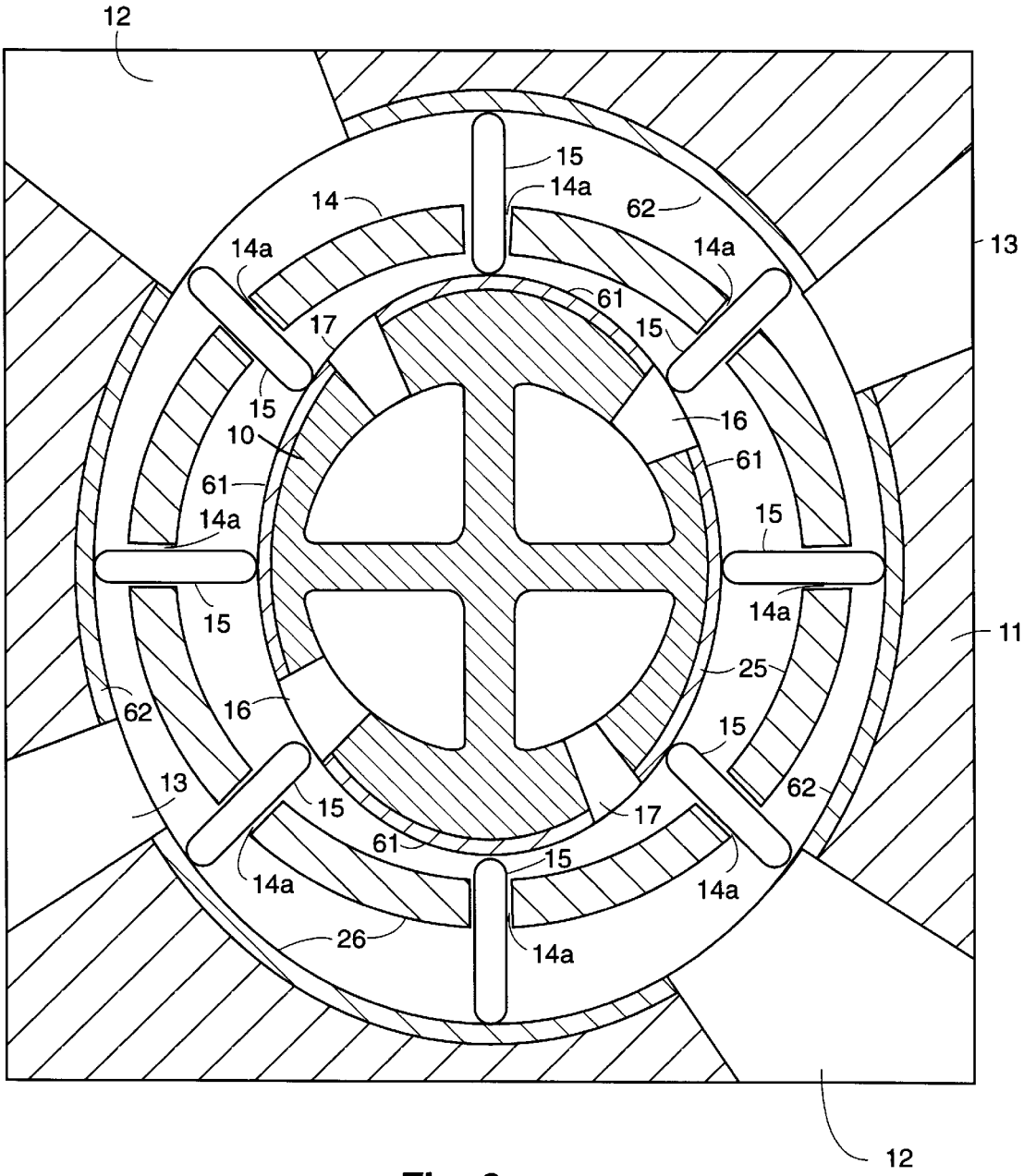
FIG. 6 is a cross-sectional frontal view similar to FIG. 1, but illustrating the application of permanent magnets embedded in the inner and outer stators to provide clearance control for the slidable vanes of the present invention.

In FIG. 6, which is imposed on the illustration of FIG. 1, an embodiment is illustrated which is intended to maintain proper clearance of vanes 15 during rotation of rotor 14. In this embodiment, outer stator 11, inner stator 10, and rotor 14 are made of non-ferrous materials, and vanes 15 are made of a ferrous material. Permanent magnets 61 are embedded in the surface of inner stator 10 and permanent magnets 62 are embedded in the inner surface of outer stator 11. Permanent magnets 61, 62 serve to maintain a constant clearance for vanes 15 during rotation of rotor 14.

Because of the centrifugal forces present when rotors 14, 33 are rotating, vanes 15 will be forced outward toward outer stator 11, increasing wear on the surface of vanes 15 that contacts outer stator 11. Because of this action, it may be satisfactory to place permanent magnets 61 only in the surface of inner stator 10.

Although apparent from the above description, it is to be emphasized that the present invention is extremely versatile. In addition to the many configurations possible with first stage 25 and second stage 26, it should also be understood that the device according to the present invention can handle fluids consisting of liquids, vapors, or solids, in any combination.

It should also be recognized that individual devices according to the present invention could be connected together, either in series or parallel. For example, two devices could be connected together, one operating as a compressor and the other as an expander to create a gas turbine engine. In this arrangement, each device could have its stages connected either in parallel or in series. In this way, reversed cycle Brayton refrigerators and air conditioners also can be provided.

The foregoing description of the preferred embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A two stage rotating vane device comprising:

an outer stator defining a plurality of ports and having an elliptically shaped interior cavity surface which defines an elliptically shaped interior cavity;

an inner stator defining a plurality of ports, said inner stator being elliptically shaped and coaxially located in said elliptically shaped interior cavity;

a rotor disposed in said elliptically shaped interior cavity between said inner stator and said outer stator, said rotor defining a plurality of slots;

a plurality of slidable vanes situated in said plurality of slots for spanning between said elliptically shaped interior cavity surface of said outer stator and said inner stator;

permanent magnets embedded in said inner cavity surface of said outer stator and in said inner stator for maintaining proper clearance of said plurality of slidable vanes;

wherein a first stage is defined between said inner stator and said rotor, and a second stage is defined between said elliptically shaped interior cavity surface of said outer stator and said rotor, said first and second stages communicating with each other.

2. A two stage rotating vane device comprising:

an outer stator having a plurality of ports and a cylindrically shaped interior cavity surface, defining an elliptically shaped interior cavity;

an inner stator defining a plurality of ports, said inner stator being configured in a specific predetermined shape and coaxially located in said cylindrically shaped interior cavity;

a rotor disposed in said shaped interior cavity between said interior cavity surface of said outer stator and said inner stator, said rotor having an axis eccentrically displaced with respect to said coaxially located said outer stator and said inner stator, said rotor defining a plurality of slots;

a plurality of slidable vanes situated in said plurality of slots for spanning between said interior cavity surface of said outer stator and said inner stator;

permanent magnets embedded in said inner cavity surface of said outer stator and in said inner stator for maintaining proper clearance of said plurality of slidable vanes;

wherein a first stage is defined between said inner stator and said rotor, and a second stage is defined between said interior cavity surface of said outer stator and said rotor, said first and second stages communicating with each other.

3. A two stage rotating vane device comprising:

an outer stator having a plurality of ports and a cylindrically shaped interior cavity surface, defining an elliptically shaped interior cavity;

an inner stator defining a plurality of ports, said inner stator being configured in a specific predetermined shape and coaxially located in said cylindrically shaped interior cavity;

a rotor disposed in said shaped interior cavity between said interior cavity surface of said outer stator and said inner stator, said rotor having an axis eccentrically displaced with respect to said coaxially located said outer stator and said inner stator, said rotor defining a plurality of slots;

a plurality of slidable vanes situated in said plurality of slots for spanning between said interior cavity surface of said outer stator and said inner stator;

permanent magnets embedded in said inner stator for maintaining proper clearance of said plurality of slidable vanes;

wherein a first stage is defined between said inner stator and said rotor, and a second stage is defined between said interior cavity surface of said outer stator and said rotor, said first and second stages communicating with each other.

* * * * *